United States Patent [19]

Arnold

[11] Patent Number: 5,014,728

[45] Date of Patent: May 14, 1991

[54] TENT

[76] Inventor: Felix Arnold, Schwabstr. 104, 7000 Stuttgart 1, Fed. Rep. of Germany

[21] Appl. No.: 464,517

[22] Filed: Jan. 16, 1990

[30] Foreign Application Priority Data

Jan. 16, 1989 [DE] Fed. Rep. of Germany ..... 3901086

[51] Int. Cl.[5] ..... E04H 15/40

[52] U.S. Cl. ..... 135/104; 135/97; 135/116; 52/2.22

[58] Field of Search ..... 135/97, 102, 104, DIG. 5, 135/116; 52/2 A, 2 K, 2 H, 2 M, 2 P, 2 N

[56] References Cited

U.S. PATENT DOCUMENTS

| | | | |
|---|---|---|---|
| 2,961,802 | 11/1960 | Mongan et al. | 135/97 X |
| 3,675,667 | 7/1972 | Miller | 135/104 |
| 3,960,161 | 6/1976 | Norman | 135/104 |
| 3,990,463 | 11/1976 | Norman | 135/104 |
| 4,590,956 | 5/1986 | Griesenbeck | 135/116 |
| 4,825,892 | 5/1989 | Norman | 135/104 |

*Primary Examiner*—David A. Scherbel
*Assistant Examiner*—Lan Mai
*Attorney, Agent, or Firm*—Edwin E. Greigg; Ronald E. Greigg

[57] ABSTRACT

A tent with a tarpaulin comprising a plurality of lengths of fabric and a set of tent poles stretching out the tarpaulin and comprising a plurality of tent poles that can be fitted together, the tent poles forming two tension frames, namely a floor frame and a roof frame, which on the one hand stretch out the lengths of fabric of the tarpaulin and on the other are supported against one another in a statically defined manner by means of lengths of fabric and/or ropes. The floor frame stretches out a flat hollow body serving as the tent floor, while the roof frame stretches out the roof and wall region of the tent tarpaulin, this region being joined to the tent floor.

27 Claims, 1 Drawing Sheet

TENT

BACKGROUND OF THE INVENTION

The invention is based on a tent as set forth herein. Such a tent shoud be as lightweight as possible for the sake of portability, should be quick to set up and should have an attractive appearance. One problem such tents have is that setting them up depends on the quality of the ground beneath, which has to provide the anchoring necessary for supporting this tent. Furthermore, the user can feel any unevenness of the ground directly through the tent floor, so that if the ground is hard, additional cushions, such as air mattresses, are needed.

It is known to stretch the tent covering over tent poles that can be fitted together and serve as a roof frame; once the poles have been assembled they are usually stretched out in arcs under the tent covering, and the tent floor is stretched out along with them. Supporting the outer covering on the bottom by means of the tent floor is also known. In each case, however, stakes or the like are needed to obtain the necessary tension with respect to the ground. These known tents all have the same disadvantage: They cannot be set up on just any surface; the situation in theoretical terms is always one of statically open (undefined) chains, which become statically defined only when additional means such as stakes are used. On hard ground, for instance, additional means such as weights or the like must be used to generate this tension. Furthermore, all these tents have the disadvantage that the tent floor rests directly on the ground on which the tent is set up.

OBJECT AND SUMMARY OF THE INVENTION

An object of the invention is to create a floored tent that does not have the above disadvantages.

A tent according to the invention, has an advantage over the prior art that the tent is shaped as a three-dimensional body that need not be additionally connected to the ground. Since the tent floor is spaced apart from the ground below it by a certain distance, the user has the advantage of not having to lie on hard ground, and on the other hand, if the ground is cold he is some distance away from it, so that moisture that is always present, even above the tent floor, cannot act as a cold-conducting bridge.

The mutual support, of the roof frame and floor frame by means of a tarpaulin stretched out over them produces a statically defined stable body. At the same time, the design of the bottom frame, which stretches out, a flat hollow body serving as the tent floor, furnishes a top floor surface that is not in direct contact with the ground. This means that cold-conducting bridges cannot be created between the ground and the top surfaces of the tent floor, where the user lies.

In an advantageous feature of the invention, the floor frame is saddle-shaped, attained by deformating a circle, and stretches out two oval lengths of fabric as the top and bottom floor tarpauline, which enclose a hollow space between them. According to the invention this saddle-shaped frame is stabilized by supports against the roof frame, thus producing a tent floor that is suitable as a surface to lie on.

In another feature of the invention, the roof frame is formed by a preferably circular arc-shaped hoop, the ends of which are supported against the floor frame.

This advantageously produces a tent that is easy to set up and has approximately the shape of a ridge tent.

In another feature of the invention, the roof frame is formed of at least two preferably circular arc-shaped hoops the ends of which are each supported in a hinge that is supported against the floor frame. In this version, the tent advantageously has the shape of an igloo or frame tent. Supporting the hinges against the floor frame stabilizes the tent.

In a further feature of the invention, the tent poles are inserted into tubular sleeves provided on the tarpaulin. By means of the tubular sleeves, the tent poles are fixed in their predetermined position, which further increases the stability of the entire tent.

In a further advantageous feature of the invention, the tarpaulin is provided with an entrance opening in one wall portion. This entrance opening, in another feature, is preferably embodied as oval to circular. This embodiment advantageously assures that supporting the tarpaulin by the two frames is maintained.

In a further advantageous feature of the invention, the entrance opening is provided with a closure device, which in another advantageous feature of the invention preferably takes the form of a drawstring-bag type of closure, with extra material , attached to the tarpaulin, that can be drawn together in a ring via a drawstring. This embodiment makes for particularly simple closure of the entrance opening.

In another feature of the invention, additional supports between the roof frame and the top floor tarpaulin is provided. By means of this additional bracing, the top floor tarpaulin can be lifted at its edges in such a way as to create a flat surface to lie on. A vertical limiting wall for the tent interior is additionally created.

In an advantageous further feature of these characteristics, the top floor tarpaulin is supported by ropes against the roof frame. As a result, the space between the inclined outer wall and the ropes advantageously remains accessible.

In another feature of these characteristics, the top floor tarpaulin is supported against the roof frame by additional lengths of fabric. The presence of two lengths of fabric provides additional advantageous protection from the weather. In the event that such additional protection is not needed, the outer length of fabric can also be left out in this embodiment.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
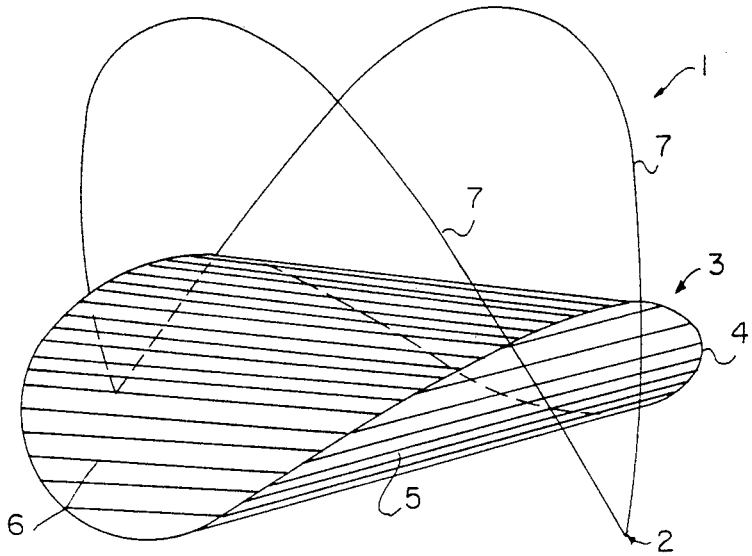
FIG. 1 is a perspective side view of the roof frame and of a floor frame with associated lengths of fabric.

FIG. 1 shows two semi circular arc-shaped hoops 7 formed of tent poles fitted together as a roof frame 1, which converge at their ends at a coupling point 2, in fact at a hinge (not shown). This hinge makes it possible to disassemble these hoops 7. In FIG. 1, these hoops 7 are shown as bare tubes; normally, they run inside suitable tubular sleeves of the tarpaulin. As used herein, the term "tarpaulin" refers to any suitable piece of waterproof cloth or other material for making a tent.

Also shown in FIG. 1 is the design of the tent floor 3, which comprises a floor frame 4 made up of tubes or tent poles fitted together, which again run in a tubular sleeve, shown in the form of a heavier line, and between them stretch out two oval lengths of fabric or other material 5 and 6. The shape of this floor frame 4 is obtained by deforming a circle into a saddle-shaped structure. The length of fabric 5 faces downward and the length of fabric 6 faces upward, creating a hollow space between the lengths of fabric 5 and 6. This hollow space can be used to store packs and other gear. The length of fabric 5 is in contact with the ground on which the tent is set up, while contrarily the length of fabric 6 serves as a surface to lie on.

Figure 2:
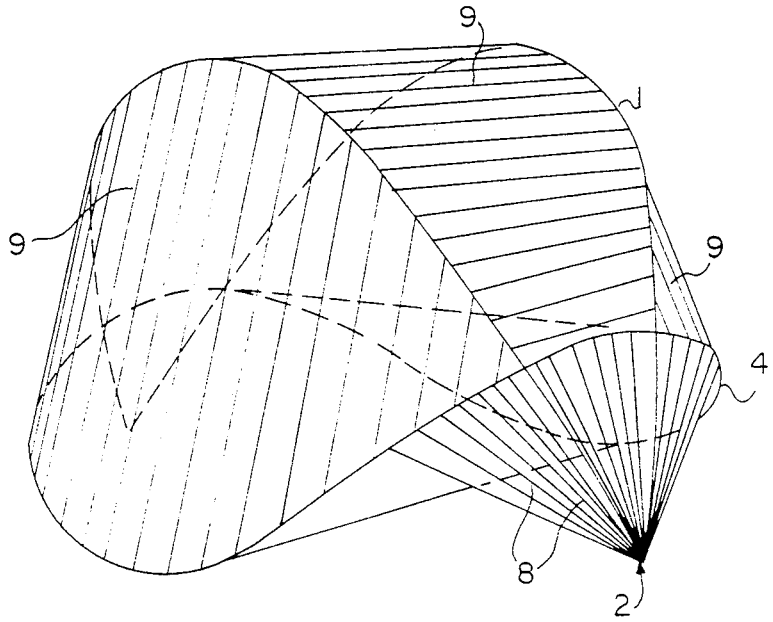
FIG. 2 is a perspective side view of a tent according to the invention with the tarpaulin stretched out.

Once the tent floor 3 has been associated with the roof frame 1, then as shown in FIG. 2 the floor frame 4 is supported by a suitable number of ropes 8 spaced along the frame at one end and secured to the coupling point 2 at the opposite end, in the course of which the floor frame 4 is pulled as tightly as possible toward the coupling point 2 on the one hand and on the other hand is also pulled against the hoops 7. Naturally a suitable tension strap can be used, instead of ropes 8.

Also shown in FIG. 2 is the outer covering 9 of the tent, which extends between the roof frame 1 and the floor frame 4 and between the two hoops 7 of the roof frame 1. This outer skin 9 defines the lowermost possible stretched-out position of the floor frame 4, so that once the tightening ropes 8 are tightened, a statically defined body is created. Because of the approximately vertically extending portions of the outer skin 9 of the tent, the two hoops 7 of the roof frame 1 are pulled apart and in so doing stretch the part of the outer tent covering 9 located between them.

Once again, the tubes of the roof frame 1 extend within tubular sleeves in the covering which produces additional stability.

Naturally the outer covering 9 of the tent may have a different course; the definitive factor is that together with the frames 1 and 4 and the coupling point 2 it unequivocally defines a statically stable system, i.e., "tent". Although not shown here, there is an entrance in the outer covering 9 of the tent in the usual manner, but because of the shaping defined here, the entrance is preferably in the form of a drawstring-bag type of closure; that is, in the taut outer covering, which serves the purpose of static stability, there is an entrance opening, because of this stabilizing function of the outer covering, the entrance opening is rigid; it is closable via a flexible closure device. The closure device may comprise either a smooth material, joined for instance via zippers, or a bag-like part that can preferably be drawn closed in the middle by a drawstring (drawstring-bag type of closure) and is attached as an additional skin onto the outer skin, without impairing the actual support of the outer covering.

Figure 3:
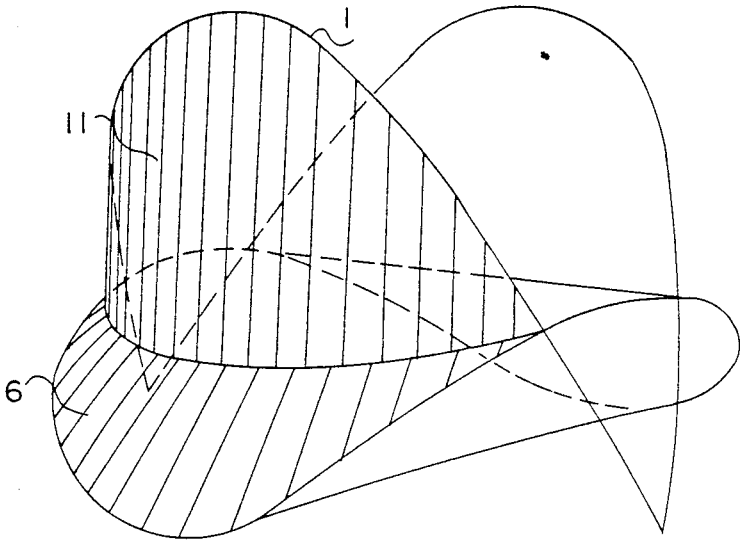
FIG. 3 is a perspective side view of a variant of the tent according to the invention, with part of the tarpaulin not shown.

FIG. 3 shows a variant in which the length of fabric 6 of the tent floor 3 is drawn upward by a length of fabric or other material 11 extending vertically toward the roof frame 1 in such a way as to produce a flat floor surface inside the tent. Instead of the length of fabric 11, ropes may naturally be used, or this length of fabric 11 may also be embodied as an outer covering.

However, the invention goes beyond this one exemplary embodiment shown and beyond the variant shown in FIG. 3.

According to the invention, the sole definitive feature is that a body is formed that defines a volume and is stretched across a floor frame; the body is defined by two preferably oval surfaces of lengths of fabric and is hung between one or more roof frames 1 and supported by this frame or frames. The outer tent covering, which is stretched over the roof frame, contributes just as much to the stability as does the tightening means with which the floor frame is tightened to the coupling points, at least two of which must be present. Naturally, each of the coupling points need not be restricted to a hinge—which in any case is not needed if there is only one roof frame; there may be a curved portion instead of a point, but in that case with a certain centering taking place at the apex of the curve frame The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A tent having a tarpaulin comprising a plurality of lengths of fabric with an integrated tent floor and a set of tent poles stretching out the tarpaulin and comprising a plurality of tent poles that can be fitted together, the fitted-together tent poles form two tension frames, namely a floor frame (4) and a roof frame (1), which stretch out the lengths of fabric comprising the tarpaulin and support one another in a statically defined manner by means of lengths of material selected from a group consisting of fabric, ropes, and fabric and ropes, wherein the floor frame (4) stretches out a flat hollow body deforming the tent floor (3) into separate layers, while the roof frame (1) stretches out the roof and wall region (9) of the tarpaulin, which region connects with the tent bottom (3).

2. A tent as defined by claim 1, in which the floor frame (4) has a saddle shape created by deformation of a circle and stretches out into two oval lengths of fabric as top and bottom floor tarpaulins (5) and (6), which between them enclose a hollow space.

3. A tent as defined by claim 2, in which the roof frame (1) is formed by a preferably semi-circular arc-shaped hoop (7), the ends of which are supported against the floor frame (4).

4. A tent as defined by claim 2, in which the roof frame (1) is formed of at least two preferably semi-circular arc-shaped hoops (7), and ends of which are each supported in a hinge (2) that is support against the floor frame (4).

5. A tent as defined by claim 2, in which the tent poles are inserted into tubular sleeves provided on the tarpaulin.

6. A tent as defined by claim 2, in which the tarpaulin is provided with an entrance opening in one wall portion.

7. A tent as defined by claim 6, in which the entrace opening is embodied as oval.

8. A tent as defined by claim 2, in which an additional support means (11) is provided between the roof frame (1) and the top floor tarpaulin (6).

9. A tent as defined by claim 8, in which the top floor tarpaulin (6) is supported against the roof frame (1) by means of ropes.

10. A tent as defined by claim 8, in which the top floor tarpaulin (6) is supported against the roof frame (1) by means of additional lengths of fabric.

11. A tent as defined by claim 1, in which the roof frame (1) is formed by a preferably semi-circular arc-shaped hoop (7), the ends of which are supported against the floor frame (4).

12. A tent as defined by claim 11, in which the tent poles are inserted into tubular sleeves provided on the tarpaulin.

13. A tent as defined by claim 1, in which the roof frame (1) is formed of at least two preferably semi-circular arc-shaped hoops (7), and ends of which are each supported in a hinge (2) that is support against the floor frame (4).

14. A tent as defined in claim 13, in which the tent poles are inserted into tubular sleeves provided on the tarpaulin.

15. A tent as defined by claim 1, in which the tent poles are inserted into tubular sleeves provided on the tarpaulin.

16. A tent as defined by claim 1, in which the tarpaulin is provided with an entrance opening in one wall portion.

17. A tent as defined by claim 16, in which the entrance opening is embodied as oval.

18. A tent as defined by claim 17 in which the entrance opening is provided with a closure device.

19. A tent as defined by claim 18, in which the closure device takes the form of a drawstring type of closure, with additional material disposed on the tarpaulin, that can be drawn together in a ring via a drawstring.

20. A tent as defined by claim 16 in which the entrance opening is provided with a closure device.

21. A tent as defined by claim 20, in which the closure device takes the form of a drawstring type of closure, with additional material disposed on the tarpaulin, that can be drawn together in a ring via a drawstring.

22. A tent as defined by claim 1, in which an additional support means (11) is provided between the roof frame (1) and the top floor tarpaulin (6).

23. A tent as defined by claim 22, in which the top floor tarpaulin (6) is supported against the roof frame (1) by means of ropes.

24. A tent as defined by claim 22, in which the top floor tarpaulin (6) is supported against the roof frame (1) by means of additional lengths of fabric.

25. A tent as defined in claim 1 wherein said lengths of material are lengths of fabric.

26. A tent as defined in claim 1 wherein said lengths of material are ropes.

27. A tent as defined in claim 1 wherein said lengths of material are fabric and ropes.

* * * * *